US006923135B2

(12) United States Patent
Kranebitter

(10) Patent No.: US 6,923,135 B2
(45) Date of Patent: Aug. 2, 2005

(54) CONTAINER FOR TRANSPORTING FRESH WATER BY SEA

(76) Inventor: Franz Kranebitter, Wohnparkstrasse A7213, A-1230 Vienna (AT)

( * ) Notice: Subject to any disclaimer, the term of this patent is extended or adjusted under 35 U.S.C. 154(b) by 0 days.

(21) Appl. No.: 10/467,189

(22) PCT Filed: Jan. 31, 2002

(86) PCT No.: PCT/AT02/00038

§ 371 (c)(1),
(2), (4) Date: Aug. 5, 2003

(87) PCT Pub. No.: WO02/062655

PCT Pub. Date: Aug. 15, 2002

(65) Prior Publication Data

US 2004/0055523 A1 Mar. 25, 2004

(30) Foreign Application Priority Data

Feb. 6, 2001 (AT) ..... A 185/2001

(51) Int. Cl.[7] ..... B63B 25/08
(52) U.S. Cl. ..... 114/74 T; 220/560
(58) Field of Search ..... 114/74 R, 74 T, 114/256, 257; 220/560

(56) References Cited

U.S. PATENT DOCUMENTS 2,997,973 A * 8/1961 Rede et al. ..... 114/74 T
3,167,103 A * 1/1965 Rede et al. ..... 220/4.15
5,445,093 A * 8/1995 Lilly, Jr. ..... 114/45
5,657,714 A * 8/1997 Hsia et al. ..... 114/256
6,390,733 B1 * 5/2002 Burbage et al. ..... 405/203

FOREIGN PATENT DOCUMENTS

| | | |
|---|---|---|
| DE | 11 10 542 B | 7/1961 |
| DE | 11 31 113 B | 6/1962 |
| EP | 0 687 625 A | 12/1995 |
| GB | 933 889 A | 8/1963 |

* cited by examiner

*Primary Examiner*—Andrew D. Wright
(74) *Attorney, Agent, or Firm*—Pandiscio & Pandiscio

(57) ABSTRACT

The invention relates to a container for transporting fresh water by sea, comprising a flexible covering for receiving fresh water and a pulling device which is joined to the flexible covering and made of a tubular retaining body which is used for coupling bridle lines. A rapid filling and emptying of the container is achieved in such a way that the tubular retaining body is enclosed at least partially by the flexible covering and that filling and emptying openings in the tubular retaining body open directly into the space enclosed by the flexible covering. The present invention further relates to a method for filling or unloading such a container.

16 Claims, 2 Drawing Sheets

Fig.1a
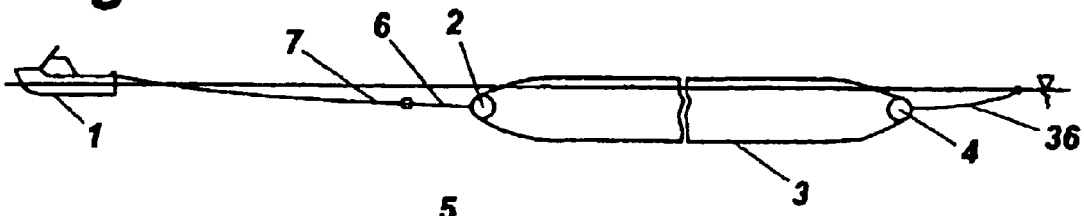
Fig.1b
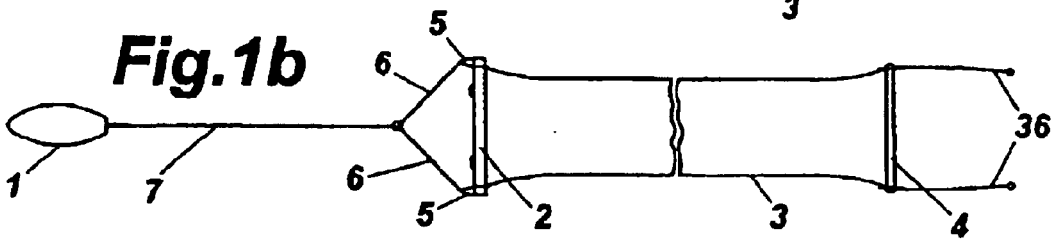
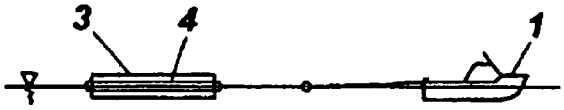
Fig.2a
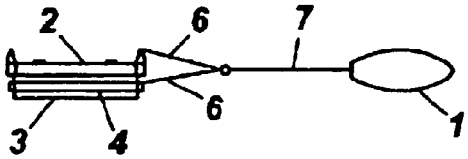
Fig.2b
Fig.3a
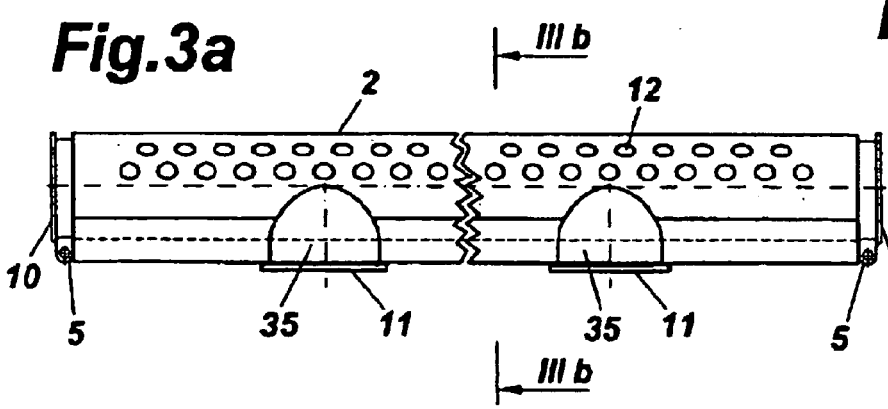
Fig.3b
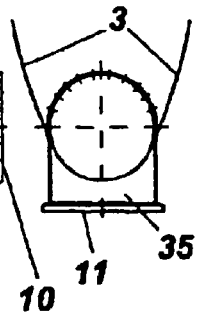

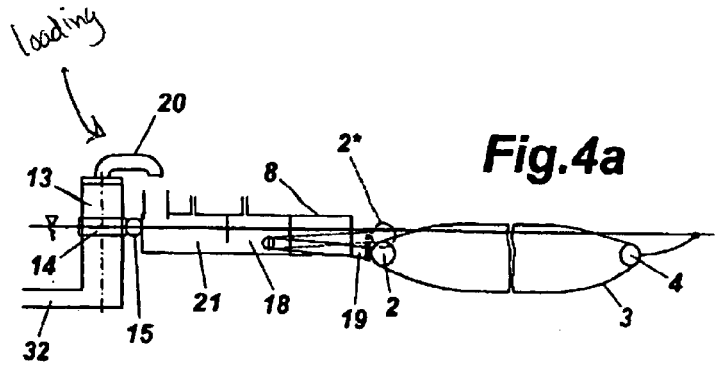
Fig.4a
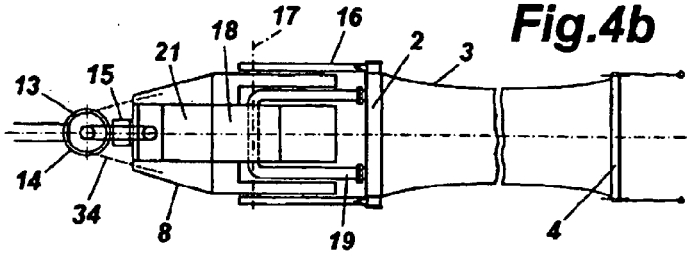
Fig.4b
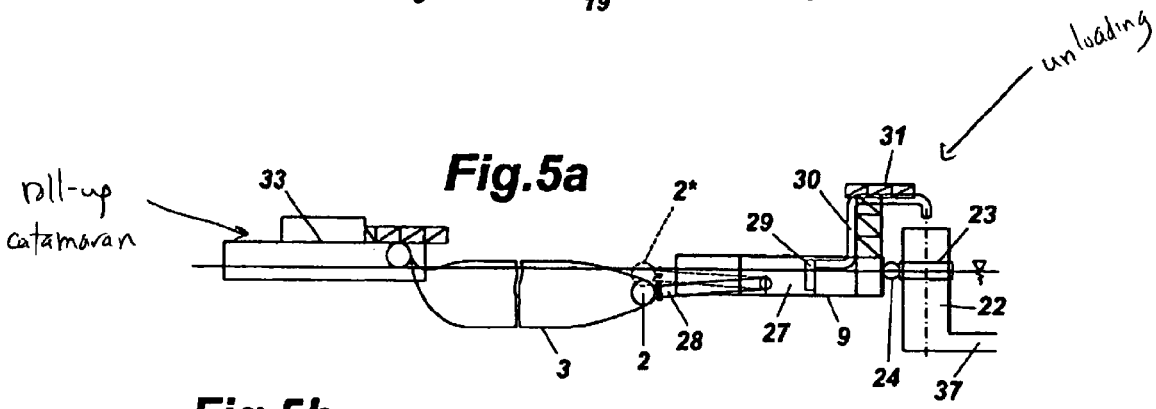
Fig.5a
Fig.5b
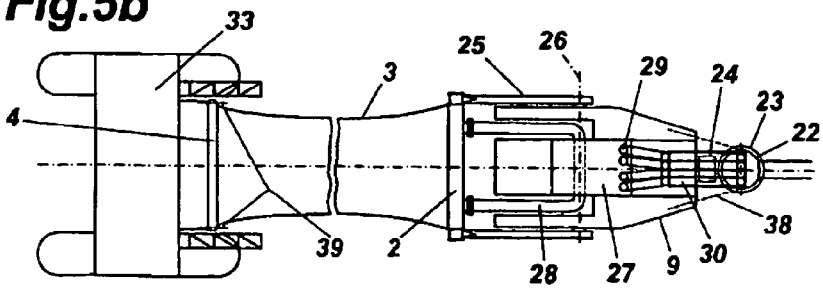

CONTAINER FOR TRANSPORTING FRESH WATER BY SEA

BACKGROUND OF THE INVENTION

The invention relates to a container for transporting fresh water by sea, comprising a flexible covering for receiving fresh water and a pulling device which is joined to the covering and is made of a tubular retaining body which is used for coupling bridle lines.

The economic transport of large quantities of fresh water by sea is gaining importance in order to supply water-starved regions close to the coast with fresh water from regions close to the coast which have a surplus of water.

The sporadic supply of water to islands and zones close to the coast during dry periods by means of tank ships has been carried out for many years, although this manner of supply is expensive and is cumbersome in loading and unloading. For some time there have been efforts to reduce transport costs by using floating, flexible containers which are pulled by small tugboats. All containers known and used in practice have the shape of a torpedo or boat and therefore have a quasi point-like fastening of the traction cable at the bow. This arrangement leads to stress peaks about said fastening point and thus often to the destruction of the flexible container. Up until now it was only possible to overcome these problems by limiting the maximum size of the flexible containers, which in current practice are close to approx. 20,000 $m^3$. A reduction in the transport costs can only be achieved by an increase in the size of the flexible containers by more than 10 times the current size. The loading and unloading occurred up until now through hoses and there are no special loading and unloading stations which have become known for handling such large quantities of water in an economical way.

A floating container is known from GB 933 889 A which comprises a flexible covering which is held at one end by a cylinder outside of the container. This may contribute to a certain extent to the distribution of mechanical forces. However, the filling and emptying of such a container is only possible via hoses or the like, as has been described above. A rapid loading and unloading of the containers in the loading and unloading stations is not possible in this way.

SUMMARY OF THE INVENTION

It is the object of the present invention to provide a container which enables a more economic transport of fresh water by sea. This is to be enabled on the one hand by an increase in the container volume in comparison with the convention containers, and on the other hand by a more rapid transshipment of the content of the container in loading and unloading stations.

These goals are achieved in accordance with the invention in such a way that the tubular retaining body is at least partially enclosed by the flexible covering and that the filling and emptying openings arranged in the tubular retaining body open directly into the space enclosed by the flexible covering. The relevant aspect of the solution in accordance with the invention is that the tubular retaining body, which is used to introduce the forces upon the flexible covering in such a way that a distribution over a large surface area is ensured, is also used for enabling an especially quick filling and emptying process. In this way it is not only possible to realize containers with a very large volume, it is also possible to ensure a rapid transshipment at the coast and thus a short dwelling time at the end points of the transportation route.

A favorable distribution of forces within the flexible covering can be achieved in such a way that the flexible covering is substantially rectangular in its layout in the empty state and that the tubular retaining body extends over the entire width of the flexible covering.

An increase in the load carrying ability of the flexible covering can preferably by achieved in such a way that the flexible covering is arranged as a seamless hose. Weak points in the region of the seams are thus substantially avoided.

It is provided for, in a preferred embodiment of the invention, that the tubular retaining body comprises fastening brackets, which are arranged on the one hand for fastening the bridle lines and on the other hand for arresting in a loading pontoon or an unloading pontoon. In this way it is possible to achieve an easy manipulation of the container from the transport position to the loading or unloading position.

It is further preferable when a plurality of filling and emptying openings are arranged in a manner so as to be distributed over the length of the tubular retaining body and that connecting pieces are provided at the front region, for loading and unloading. An especially high flow rate can thus be achieved during filling or emptying.

For a simple manipulation of the container, and in accordance with a preferred embodiment of the present invention, it is advantageous when the retaining body assumes a predetermined height in the water. The height can preferably be set in such a way that a floating body is provided on the tubular retaining body.

The invention further relates to a method for filling or emptying a container of the kind described above. In accordance with the invention, this method is characterized in that the tubular retaining body is connected for filling purposes with a loading pontoon having a collecting tank for fresh water and that the collecting tank is connected with the tubular retaining body for the transfer of fresh water. It is especially appropriate when the tubular retaining body is joined with the loading pontoon via swiveling loading pipelines in order to compensate the changing immersion depth of the retaining body.

A technically especially simple solution of the method in accordance with the invention is given when during the filling of the container the fresh water is supplied via a loading tower into the loading pontoon, with the fresh water preferably being transferred from the loading tower to the loading pontoon in free fall.

The unloading can preferably be accelerated in such a way, that the container is rolled up by a roll-up catamaran for performing the unloading process.

In order to dissipate the forces by wind and the motion of the sea, which act upon a large container, it is preferable that when the tubular retaining body is fastened via the bridle lines to the unloading pontoon during the emptying of the container. It is especially appropriate in this connection when the loading pontoon is held in a manner so as to be swiveling around a loading tower during the emptying of the container. The same applies in an analogous manner to the filling of the container.

BRIEF DESCRIPTION OF THE DRAWINGS

The invention is now explained in closer detail by reference to the embodiments shown in the drawings, wherein:

FIG. 1*a* shows a schematic representation in a side view of a container in accordance with the invention which is pulled by a tugboat;

FIG. 1*b* shows the container of FIG. 1*a* in a top view;

FIG. 2*a* shows an embodiment of the invention in a side view during transport in the empty state;

FIG. 2*b* shows the embodiment of FIG. 2*a* in a top view during the transport in the empty state;

FIG. 3*a* shows a view of a detail of an apparatus in accordance with the invention in a top view;

FIG. 3*b* shows a sectional view along line IIIb—IIIb in FIG. 3*a*

FIG. 4*a* shows a side view of a container in accordance with the invention in a loading station;

FIG. 4*b* shows a view according to FIG. 4*a* from above;

FIG. 5*a* shows a container in accordance with the invention in an unloading station in a side view, and FIG. 5*b* shows a view according to FIG. 5*a* from above.

DETAILED DESCRIPTION OF THE PREFERRED EMBODIMENTS

FIGS. 1*a* and 1*b* show a container in accordance with the invention during the transport in the filled state. A tugboat 1 is connected with the container via a hawser 7 and two bridle lines 6 which are fastened to brackets 5 of a retaining body 2 which is configured substantially in the shape of a tube. A hose-like flexible covering 3 is fastened to the retaining body 2 which in the top view is substantially rectangular and is filled with fresh water. At the end of the flexible covering 3, opposite of the retaining body 2, an end pipe 4 is provided which is also arranged in the shape of a cylinder and which closes off the flexible covering 3. Through bridle lines 36 the illustrated container can be coupled to a tugboat.

FIGS. 2*a* and 2*b* show the transport of a container in accordance with the invention in the emptied state. The flexible covering 3 is wound up on the end pipe 4 and the retaining body 2 is situated directly adjacent to said wound covering. In order to minimize traveling resistance, the container is pulled in the axial direction of the retaining body 2 or the end pipe 4.

FIGS. 3*a* and 3*b* show the retaining body 2 in detail. In the region of the retaining body 2, which is oriented towards the interior of the flexible covering 3 (not shown here), a plurality of filling and emptying openings 12 are provided through which fresh water can flow from the inner space of the retaining body 2 to the interior space of the flexible covering 3. The supply of fresh water to the interior of the retaining body 2 occurs via connecting pieces 35.

FIGS. 4*a* and 4*b* show the filling process of the container in accordance with the invention. The fresh water flows via a feed pipeline 32 into a cylindrically configured loading tower 13 whose upper side comprises an outlet 20 from which the fresh water is allowed to flow out in free fall. A ring 14 is arranged in a height-adjustable fashion on the loading tower 13. A loading pontoon 8 is fastened to said ring by means of a cable 34 and an interposed fender 15. A collecting tank 21 is arranged in the loading pontoon 21 in which the fresh water is collected from the outlet 20. A venting tank 18 is adjacent to the collecting tank 21 which is used to remove the air introduced into the fresh water.

Laterally swiveling docking arms 16 are attached to the loading pontoon 8 onto which the retaining body 2 of the container can be docked. Docking arms 16 swivelling together with the loading pipelines 19 are provided through which the fresh water flows from the venting tank 18 to the retaining body 2.

The entire arrangement consisting of the loading pontoon 8 and the container in accordance with the invention, which is coupled to the same, is swivelling around the vertical axis of the loading tower 13 during the loading process according to weather condition and changing in height according to the sea level. Cables securing lines 34 are provided for fixing the loading pontoon to the loading tower and can be loosened in the case of storms in order to avoid any damage to the container. As a result of the flexibility it is reliably prevented that even in the case of heavy sea or storms inadmissibly large forces will be exerted on the loading tower 13 or the loading pontoon 8 which could lead to damage.

FIGS. 5*a* and 5*b* show the unloading process of the container in accordance with the invention. A roll-up catamaran 33 is provided for rolling up the flexible covering 3 of the container on the end pipe 4. The rolling-up process is secured by end disks 39 which are attached to the side of the end pipe 4. During unloading, the retaining body 2 is fastened to the docking arms 25 and the container is emptied via unloading pipelines 28. The docking arms 25 and the unloading pipelines 28 are swivelably fastened to an unloading pontoon 9, which contains a collecting tank 27. Several submerged pumps 29 are installed in the collecting tank 27, pumping the fresh water through pipelines 30 which are fastened to a supporting frame 31. The fresh water flows from the pipeline 30 in free fall into an unloading tower 22 and flows from there via pipeline 37 to shore.

In analogy to the loading pontoon 8, the unloading pontoon 9 is fastened to a ring 23 via a fender 24, which ring slides in a rotatable and height-adjustable manner on the unloading tower 22. A fender 24 is used to keep the unloading pontoon 9 at a predetermined distance from the unloading tower 22.

FIGS. 4*a* and 5*a* show with phantom lines a position of the docking arms 16 and 25 plus attached retaining body 2 before the loading process has started and after the unloading process has finished. For distinction purposes the retaining body 2 is designated here with 2*. This representation shows the swivelability of the docking arms 16 around the axis 17 and the swivelability of the docking arms 25 around the axis 26.

The unloading pontoon 9 is provided with a sufficiently strong power supply for the operation of its pumps and winches in order to secure a fast emptying. This fast emptying is achieved in particular in such a way that the water from the interior of the flexible covering 3 can flow into the retaining body 2 via the filling and emptying openings 12 or, vice versa, in the case of filling from the retaining body 2 via the filling and emptying openings 12 into the flexible covering 3.

The use of the roll-up catamaran 33 allows the water to flow from the flexible covering 3 into the collecting tank 27 without using any pumps.

What is claimed is:

1. A container for transporting fresh water by sea, comprising a flexible covering for receiving fresh water and a pulling device which is joined to the flexible covering, which comprises a tubular retaining body and which is used for coupling bridle lines, wherein the tubular retaining body is enclosed at least partially by the flexible covering and filling and emptying openings in the tubular retaining body open directly into a space enclosed by the flexible covering wherein a plurality of said filling and emptying openings are arranged in a manner so as to be distributed over the length of the tubular retaining body and that connecting pieces are provided on a front side of the tubular retaining body, and connecting pieces are configured, and open to an outside region opposite to the flexible coverings.

2. A container as claimed in claim 1, wherein the flexible covering is substantially rectangular in its layout in the empty state and that the tubular retaining body extends over the entire width of the flexible covering.

3. A container as claimed in claim 1, wherein the flexible covering is configured as a seamless hose.

4. A container as claimed in claim 1, wherein at an end of the flexible covering which is distal from the tubular retaining body an end pipe is provided which comprises end disks.

5. A container as claimed in claim 1, wherein the tubular retaining body comprises fastening brackets which are configured on the one hand for fastening the bridle lines and on the other hand for arresting in a loading pontoon or an unloading pontoon.

6. A method for filling and emptying a container for transporting fresh water by sea, comprising the steps of:

joining a flexible covering for receiving fresh water and a pulling device to one another, wherein the flexible covering comprises a tubular retaining body, and joining the tubular retaining body together with a loading pontoon having a collecting tank for fresh water, wherein and that the collecting tank is connected with the tubular retaining body for transferring fresh water;

separating the tubular retaining body from the loading pontoon;

joining the tubular retaining body with an unloading pontoon for emptying the container, wherein the unloading pontoon comprises a collecting tank for fresh water; and connecting the collecting tank with the tubular retaining body for the transfer of fresh water;

wherein the container is rolled up by a roll-up catamaran in order to perform an unloading process.

7. A method as claimed in claim 6, wherein the tubular retaining body is connected via swiveling loading pipelines with the loading pontoon in order to compensate the fluctuating immersion depth of the tubular retaining body.

8. A method as claimed in claim 6, wherein the tubular retaining body is fastened via bridle lines to the loading pontoon during filling of the container.

9. A method as claimed in claim 6, wherein the loading pontoon is held swiveling about a loading tower during loading of the container.

10. A method as claimed in claim 6, wherein the loading pontoon is held remote from a loading tower by a fender during loading of the container.

11. A method as claimed in claim 6, wherein during the filling of the container the fresh water is supplied via a loading tower to the loading pontoon, with the fresh water being transferred in free fall from the loading tower to the loading pontoon.

12. A method as claimed in claim 6, wherein the tubular retaining body is connected via swiveling unloading pipelines with the unloading pontoon in order to provide compensation for a fluctuating immersion depth of the retaining body.

13. A method as claimed in claim 6, wherein the tubular retaining body is fastened to the unloading pontoon via the bridle lines during unloading of the container.

14. A method as claimed in claim 6, wherein the unloading pontoon is held swivelably about an unloading tower during unloading of the container.

15. A method as claimed in claim 6, wherein the unloading pontoon is held remote from an unloading tower by means of a fender during unloading of the container.

16. A method as claimed in claim 6, wherein during unloading of the container the fresh water is supplied from the unloading pontoon to an unloading tower, with the fresh water being transferred in free fall from the unloading pontoon to the unloading tower.

* * * * *